United States Patent [19]

Lawman et al.

[11] Patent Number: 4,624,448

[45] Date of Patent: Nov. 25, 1986

[54] LOW PROFILE, HIGH RISING LIFTING MECHANISM

[76] Inventors: Dennis J. Lawman, R.R. #2, Box 165, Laurens, Iowa 50554; Gary G. Greenwood, 311 W. Elm, Pocahontas, Iowa 50574

[21] Appl. No.: 737,674

[22] Filed: May 28, 1985

[51] Int. Cl.[4] ..... B66F 3/24

[52] U.S. Cl. ..... 254/122

[58] Field of Search ..... 254/122, 124, 8 C, 9 C, 254/126

[56] References Cited

U.S. PATENT DOCUMENTS

| | | | |
|---|---|---|---|
| 1,982,642 | 12/1934 | Curok | 254/122 |
| 2,427,808 | 9/1947 | Pluta et al. . | |
| 2,503,347 | 4/1950 | Miller . | |
| 2,508,934 | 5/1950 | Berg . | |
| 2,567,681 | 9/1951 | Schwartz et al. . | |
| 2,747,692 | 5/1956 | Holmes | 254/122 |
| 3,226,086 | 12/1965 | Lavieri et al. | 254/124 |
| 3,635,440 | 1/1972 | Van Gompel . | |
| 3,997,143 | 12/1976 | Rose . | |

FOREIGN PATENT DOCUMENTS

| | | | |
|---|---|---|---|
| 563304 | 11/1932 | Fed. Rep. of Germany | 254/122 |
| 953593 | 5/1949 | France | 254/122 |
| 560818 | 6/1977 | U.S.S.R. | 254/122 |

*Primary Examiner*—Robert C. Watson

*Attorney, Agent, or Firm*—Zarley, McKee, Thomte, Voorhees & Sease

[57] ABSTRACT

A lifting mechanism having a support plate positioned over a base plate and having first and second pairs of spaced apart hinged arms pivotally connected to opposite corresponding ends of the support and base plates. Connecting means are attached between each pair of hinged arms and an extensible and retractable power means is operatively connected between the connecting means. Operation of the power means causes the connecting means to be moved towards or away from each other which in turn causes the hinged arms to straighten upwardly or fold downwardly to raise or lower the support plate with respect to the base plate. Additional embodiments of the invention include reinforcement bars and stabilizer means having stabilizer tracks and stabilizer bars.

14 Claims, 7 Drawing Figures

LOW PROFILE, HIGH RISING LIFTING MECHANISM

BACKGROUND OF THE INVENTION

1. Field of the Invention

This invention relates to a lifting mechanism, more particularly, a lifting mechanism having a closed position of low height and having an increasing lifting power upon extension upwardly.

2. Problems in the Art

Many different lifting mechanisms have been developed and are currently used. Because of the diverse requirements needed for various lifting tasks, a variety of lifting principals as well as a variety of different structures exist with regard to these lifting mechanisms.

A common lifting mechanism is a pivotally connected cross lever jack commonly known as a scissors jack. Examples of such a jack and its operation can be seen in the U.S. Pat. Nos. 2,508,934 to Berg, 2,567,681 to Schwartz et. al., and 3,997,143 to Rose. Some of the reasons for the widely adopted success of the scissors-type jack are its simplicity in structure, its relatively small weight compared to its strength and durability, its small size compared to its lifting power, and its compact size compared to its lifting height.

A usual means for causing the scissor-type jack to raise and lower is the utilization of a screw rod which is threaded through block members pivotally attached to opposing pairs of scissored arms. An improvement to the scissors-jack consisted of utilizing hydraulic power to a cylinder to replace the screw rod and blocks. Further improvements consisted of utilizing electric power in conjunction with the screw rod and blocks.

Although the advantages of the scissors-type jack have been pointed out, problems and difficiencies still exist with this type of device. Because of the crossed nature of its lifting links, the scissors-type jack cannot be compressed to a minimum height, or extended to maximum height to the extent that is needed or desired at times. The lifting power of such a jack is many times insufficient over the entire lifting range. Stability also becomes a problem, particularly at more extended positions. The structure of the scissors jack also does not allow for drive means such as hydraulic cylinders or electronic motors to be placed in the middle of the jack, but rather must be positioned outside thereby unbalancing the jack and contributing to some instability.

It is therefore a primary object of the invention to provide a lifting mechanism which solves or improves over the deficiencies in the art.

A further object of this invention is to provide a lifting mechanism which can attain a small collapsed minimum height.

A further object of this invention is to provide a lifting mechanism which can also be extended to a high maximum height.

Another object of this invention is to provide a lifting mechanism which exerts increased lifting power as it is extended upwardly.

Another object of the invention is to provide a lifting mechanism which is simple in structure and operation.

A further object of this invention is to provide a lifting mechanism which has stability and strength.

Another object of the invention is to provide a lifting mechanism which can be adapted to operate in conjunction with a variety of power mechanisms.

Another object of the invention is to provide a lifting mechanism which is durable, economical, and easy to transport and maintain.

These and other objects, features, and advantages of the invention will become aparent with reference to the accompanying specification and claim.

SUMMARY OF THE INVENTION

This invention utilizes an upper support plate positioned over a corresponding base plate which is generally positioned on the ground or on some other stable and secure base support. A pair of hinged lifting arms are attached between the support plate and base plate at corresponding ends. Each pair of lifting arms has secured between it a connecting means for stability and for attachment of a power means which can be operated to extend or retract and as a result push or pull the connecting means towards or away from each other. This causes the pairs of lifting arms to either collapse or extend, thereby lifting or lowering the support plate as desired.

Each pair of lifting arms hinges outwardly from its respective ends of the support plate and base plate. The connecting means, in the preferred embodiment, extends between the hinged points of the lifting arms. The lifting arms are pivotally connected to the support plate and the base plate along the sides of the support and base plates near the respective end of attachment.

Any power means which can extend and retract can be used with the invention, with the preferred power means being a hydraulic cylinder. Screw-rod and blocks could also be used, as could an electric drive screw-rod and blocks.

Additional embodiments include utilization of stabilizer bars and reinforcement bars for the lifting arms, and a safety valve for a hydraulic cylinder, if used.

DETAILED DESCRIPTION OF THE PREFERRED EMBODIMENT

Figure 1:
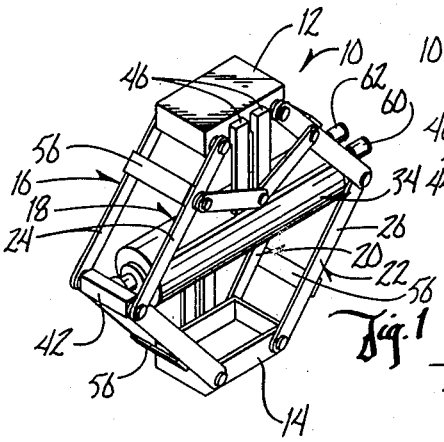
FIG. 1 is a perspective view of the invention.

With reference to the drawings, in particular FIG. 1, there is shown a low profile high rising lifting mechanism 10 in accordance with the invention. An upper support plate 12 is positioned directly over a base plate 14. Upper support plate 12 is connected to base plate 14 by two pairs of hinged lifting arms, the first pair being comprised of lifting arms 16 and 18, the second pair being comprised of lifting arms 20 and 22.

Each lifting arm 16, 18, 20, and 22 is comprised of an upper portion 24 and a lower portion 26. The upper ends of upper portions 24 are pivotally attached to upper support plate 12 by bolt means 28 whereas the lowermost ends of lower portions 26 are pivotally attached to base plate 14 by bolt means 30. The lowermost end of upper portion 24 is then hingeably attached to the uppermost end of lower portion 26 by bolt means 32. Thus, each lifting arm 16, 18, 20 and 22 has an upper portion 24 and lower portion 26 which are hingeable with respect to each other, and which have uppermost and lowermost ends which are pivotally attached to upper support plate 12 and base plate 14 respectively. This allows upper support plate 12 to move vertically with respect to base plate 14.

By referring to FIG. 1, it can be seen that in the preferred embodiment, upper support plate 12 and base plate 14 are generally rectangular in configuration. The uppermost ends of lifting arms 16 and 18, comprising the first pair of hinged lifting arms, are attached to one end of upper support plate 12 at opposite sides. The uppermost ends of lifting arms 20 and 22, comprising the second pair of hinged lifting arms, are attached to the other end of uppersupport plate 12 at opposite sides. The lowermost ends of the first and second pairs of lifting arms are attached to opposite ends of base plate 14 on opposite sides directly corresponding with the attachment of the upper ends of the pairs of lifting arms to upper support plate 12.

Upper portions 24 of lifting arms 16 and 18 are elongated bar-shaped pieces which extend parallel from upper support plate to hinged connections at lower portions 26 of lifting arms 16 and 18, which in turn are elongated bar-shaped members which are parallelly disposed and pivotally attached at the lowermost ends to base plate 14. The configuration of the second pair of lifting arms comprised of lifting arms 20 and 22 is a mirror image of lifting arms 16 and 18.

The manner in which the hinged lifting arms 16, 18 and 20, 22 are extended or collapsed in order to raise or lower upper support plate 12 is accomplished by utilizing a hydraulic cylinder 34 disposed between the two pairs of lifting arms 16, 18 and 22, 22 and having one end secured to a block member 36 which is pivotally positioned upon a rod 38 extending between the pivot points defined by bolt members 32 of lifting arms 20, 22, and having a piston rod end 40 which is attached to block member 42 which is disposed upon a rod 44 extending between bolt means 32 of lifting arms 16, 18.

Hydraulic cylinder 34 is a dual-action hydraulic cylinder such as is known in the art, meaning that hydraulic pressure can be exerted upon either side of the piston of the cylinder so that the piston rod can be extended or retracted under power.

When hydraulic cylinder 34 is operated to retract piston rod end 40, the pivotal attachment of hydraulic cylinder 34 to rods 38 and 44 causes lifting arm pairs 16, 18 and 20, 22 to straighten up and extend, thus raising upper support plate 12. Correspondingly, powering hydraulic cylinder 34 to extend piston rod end 40 would cause the controlled collapse of lifting arm pairs 16, 18 and 20, 22 and the concurrent lowering of upper support plate 12.

Figure 2:
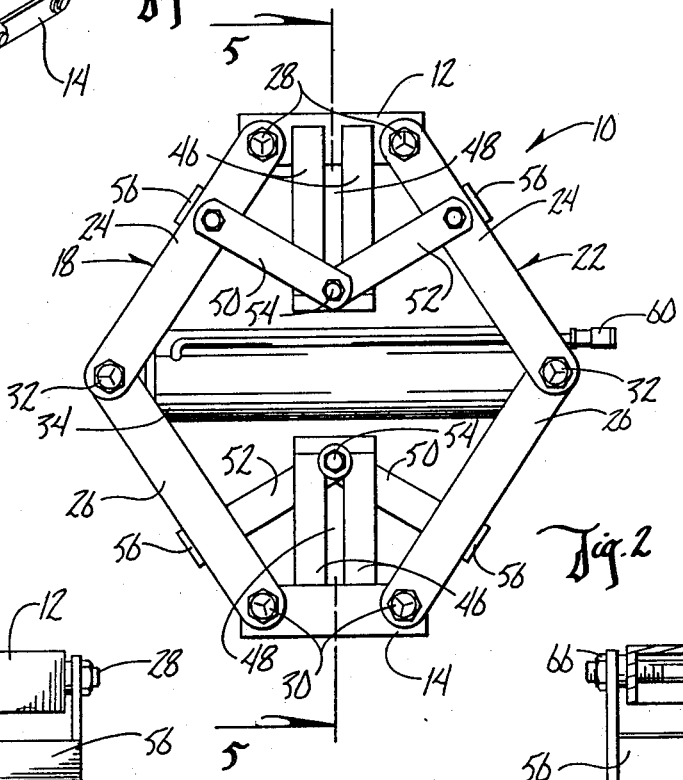
FIG. 2 is a front elevational view of the invention.

FIG. 2 shows the orientation of the lifting arms of the invention, when the upper support plate 12 is raised to its upper most position. It is particularly pointed out that lifting arm 18 of the first pair of lifting arms is oppositely opposed to lifting arm 22 of the second pair of lifting arms so that each pair of lifting arms is bent oppositely from the other. This allows the hydraulic cylinder 34 to be placed interiorly of the pairs of lifting arms allowing the invention 10 be more compact and have a better center of gravity.

FIG. 2 also depicts an optional feature of the invention 10 which can be advantageously utilized. A channel member 46 having a channel 48 running longitudinally therethrough, could be attached to upper support plate 12 and extended downwardly between upper portions 24 of lifting arms 18 and 22. Two stabilizer bars 50 and 52 are then both attached at one of their ends to a pin 54 which is retained within channel 48. The opposite ends of stabilizer bars 50 and 52 are then each pivotally attached to the upper portion 24 of lifting arms 18 and 22 respectively. Upon the raising and lowering of upper support plate 12, stabilizer bar 50 and 52 cooperate with pin 54 and channel 48 to further stabilize the invention 10.

The exact same stabilizing structure could be also added to the lower portions 26 of lifting arms, and as shown in FIGS. 1 and 2, it is preferred that this stabilizing structure be attached to the opposite side of the invention from that attached to the upper portion 24, namely stabilizer bars 50 and 52 should be attached to lower portions 26 of lifting arms 16 and 20.

Figure 3:
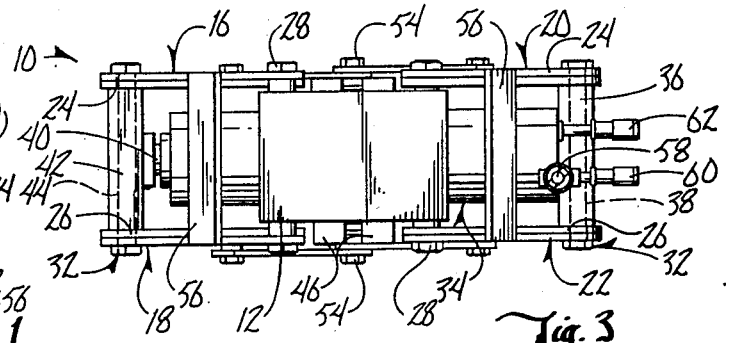
FIG. 3 is a top plan view of the invention.

FIG. 3 shows the upper surface of upper support plate 12 and the symetrical orientation of each pair of lifting arms. Additionally, FIG. 3 shows another optional feature of the invention, namely reinforcement bars 56 which extend between corresponding upper portions 24 and lower portions 26 of each pair of lifting arms 16, 18 and 20, 22 respectively. Reinforcement bars 56 are rigid elongated pieces which are securely mounted in place by welding or otherwise. Reinforcement bars 56 serve to increase stability of the invention 10 and to provide further support, reinforcement, and durability to lifting arms 16, 18 and 20, 22.

Figure 4:
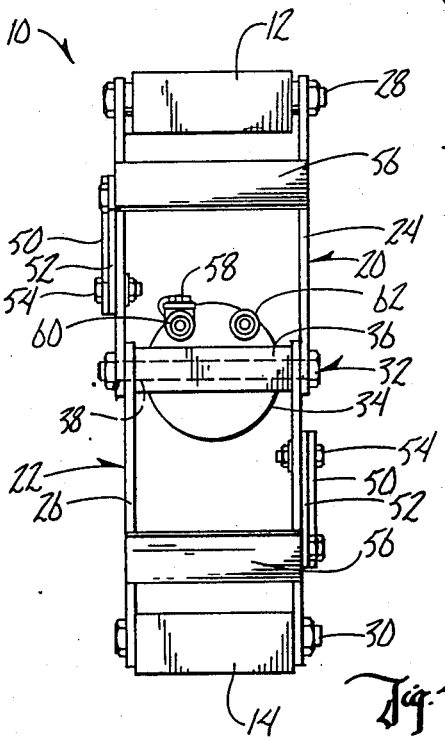
FIG. 4 is a side elevational view of the right side of the invention as shown in FIGS. 1–3.

FIG. 4 shows in elevation one end of the invention 10, in particular, reinforcement bars 56. An additional feature, a safety valve 58, is also shown with respect to hydraulic cylinder 34. Because hydraulic pressure is needed for both sides of the piston of hydraulic cylinder 34, two pressurized hydraulic inlets are needed. Hydraulic inlet 60 is in fluid communication with the end of hydraulic cylinder 34 from which piston rod 40 extends whereas hydraulic inlet 62 is in fluid communication with the opposite end of hydraulic cylinder 34. Therefore, introduction of pressurized hydraulic fluid through hydraulic inlet 60 causes the piston within hydraulic cylinder 34 to be moved towards the opposite end of hydraulic cylinder 34 pulling piston rod 40 inwardly and thus causing the pairs of lifting arms 16, 18 and 20, 22 to converge and extend, raising upper support plate 12. If upper support plate 12 is raised and is lifting an object such as a heavy piece of equipment, a real danger exists in that if hydraulic pressure is lost to hydraulic cylinder 34, the weight of the object being lifted would collapse the the invention 10. Therefore, safety valve 58 can optionally be put inline of hydraulic inlet 60, so that once hydraulic pressure is supplied through hydraulic inlet 60, safety valve 58 can be closed to preserve hydraulic pressure to the end of hydraulic cylinder 34. Thus, no matter what happens to the hydraulic pressure source, lifting mechanism 10 will remain in its extended position. Safety valve 58 is of any standard configuration as is known within the art. It is to be understood that safety valve 58 could also be utilized in hydraulic inlet 60, but because hydraulic inlet 60 serves only to allow a controlled collapse of the invention 10, safety valve 58 is not used in hydraulic inlet 62 in the preferred embodiment.

Figure 5:
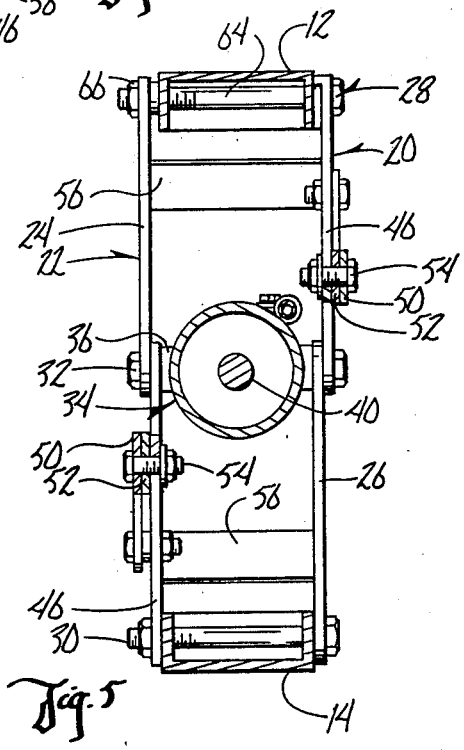
FIG. 5 is a sectional view taken along lines 5—5 of FIG. 2.

FIG. 5 illustrates a sectional view of the invention taken along lines 5—5 of FIG. 2. In particular, it can be seen that bolt means 28 and 30, attaching the ends of lifting arms 16, 18, 20, and 22 to either upper support 12 or base plate 14, could be accomplished by utilizing one bolt 64 and nut 66 to pivotally attach the adjacent ends of each pair of lifting arms to support plate 12 or base plate 14. Likewise, bolt means 32 and rod 38 and bolt means 32 and rod 44, could each be unified by utilizing one bolt and nut through each pair of lifting arms and each block member 36 and 42.

Figure 6:
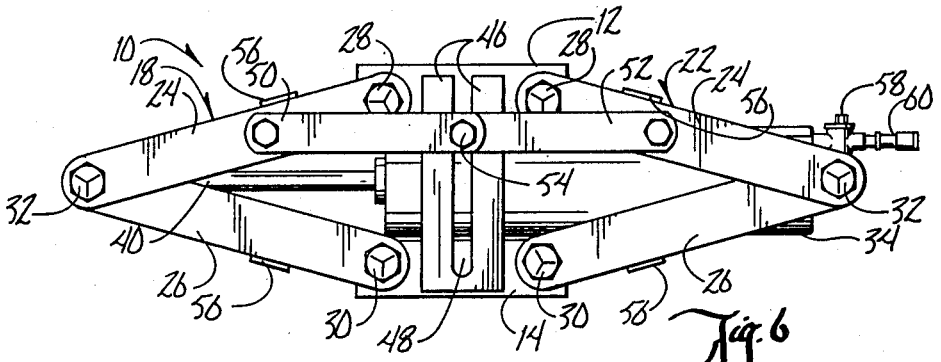
FIG. 6 is a front elevational view of the invention in its low-profile, collapsed state.

FIG. 6 shows the invention 10 in its most collapsed state, wherein hydraulic pressure has been applied to hydraulic cylinder 34 to extend piston rod 40 outwardly to its maximum outward length. Because lifting arm pairs 16, 18 and 20, 22 hinge outwardly and oppositely from one another, support plate 12 can be lowered to an extremely low profile. Stabilizer bars 50 and 52 become horizontally disposed as pin 54 moves upwardly within channel 48 as the invention 10 becomes collapsed. Stabilizer bars 50 and 52 also serve to function as a safety stop and also take some of the load off of hydraulic cylinder 34 in its extended position.

Figure 7:
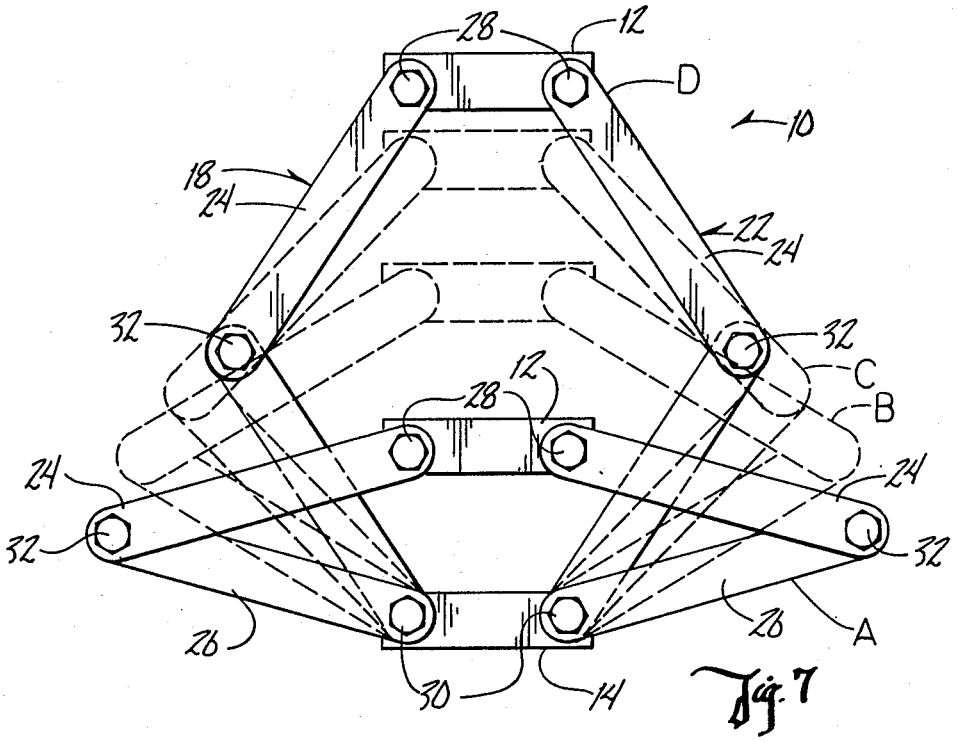
FIG. 7 is a schematic of the invention showing the manner in which the lifting arms raise the upper support plate.

FIG. 7 schematically shows the orientation of lifting arms for a plurality of different heights of upper support plate 12.

Four positions are depicted, and have been referenced with letters A, B, C and D. Position A is the collapsed or down position of the invention 10 and in the preferred embodiment, the angle between the upper and lower portions of each lifting arm is approximately 15 degrees. Position B is an intermediate position where the angle between upper portions 24 and lower portions 26 of the lifting arms is approximately 30 degrees, whereas position C, another intermediate position closer to the extended position for the invention 10, presents an angle of 45 degrees for the upper and lower portions of the lifting arms. Position D, depicting the full extended or up position of the invention 10 shows that the upper and lower portions of each lifting arm are oriented at approximately a 60 degree angle.

It is to be understood that the maximum extended height of the invention 10 is determined by the combined vertical lengths of the upper portion 24 and the lower portion 26 of the lifting arms. However, generally the hydraulic cylinder is such that lifting arms are never completely extended and, as a practical matter, the length of the housing for the hydraulic cylinder 34 limits the extent to which the invention 10 can be raised.

The minimum height or downwardmost height of the invention 10 is limited only by the length of extension of the hydraulic cylinder 34 and the height of the housing of the hydraulic cylinder 34 and the lengths of stabilizer bars 52, if utilized.

In the preferred embodiment, the sides of the upper support plate 12 and base plate 14 are eight inches long whereas the length of both upper portions 24 and lower portions 26 is approximately fourteen inches. Utilizing these specifications, the collapsed or down position height of position A of FIG. 7 would be eight inches. The total length of the invention 10 in position A would be twenty-five inches. The extended or up position height shown in position D would be approximately twenty-one inches, rendering a lifting height of approximately thirteen inches from down position A to up position D.

In operation, the invention functions as follows. The invention 10 would be transported to a desired location and positioned so that base plate 14 is on a stable and secure support, such as the ground. A hydraulic pressure source (not shown) would then be connected to the invention 10 through hydraulic inlets 60 and 62. The hydraulic source would then be operated so as to introduce pressurized hydraulic fluid through hydraulic inlet 60 which would cause the piston and piston rod 40 in hydraulic cylinder 34 to move inwardly into the hydraulic cylinder 64 and cause each pair of lifting arms 16, 18 and 22, 22 to extend and converge towards one another lifting upper support plate 12.

Upon reaching the desired lifting height, safety valve 58 would be closed to ensure that the lifting height would be maintained. Once done, the hydraulic power source connections could be removed.

Upon completion of the desired operations to the lifted object, the hydraulic power source is connected and operated to introduce pressurized fluid into hydraulic inlet 62, safety valve 58 is opened, and pressurized hydraulic fluid is withdrawn through hydraulic inlet 60. The piston of hydraulic cylinder 34 is thus forced in the opposite direction and piston rod 40 causes the pairs of lifting arms to collapse in a controlled manner to the down position, or any other position between the raised position and the down position.

The low profile of the invention 10 in the down position allows it to be utilized in many cases where conventional jacks cannot. Moreover, the configuration of the invention 10 and the lifting arms allows the invention 10 to be converted from low profile collapsed position into a high lifting height extended or up position.

The design of lifting arms 16, 18 and 20, 22 causes the lifting power of the invention 10 to increase over the range of positions A, B, C and D. In the preferred embodiment, if a hydraulic cylinder is used with a five inch bore and a one and one-half inch shaft, two thousand pounds per square inch hydraulic force creates 34,736 pounds of force which translates to 9,575 pounds of lifting force for position A of FIG. 7. At position B, 20,632 pounds of lifting force is created; at position C 35,736 pounds of lifting force. Finally, at position D, 61,895 pounds of lifting force are created.

The included preferred embodiment is given by way of example only, and not by way of limitation to the invention, which is solely described by the claims herein. Variations obvious to one skilled in the art will be included within the invention defined by the claims.

What is claimed is:

1. A lifting mechanism comprising:

a support plate positioned above a base plate each having corresponding first and second opposite ends and first and second opposite sides;

a first pair of spaced apart hinged arms pivotally connected between said first ends of said support and base plates;

a second pair of spaced apart hinged arms pivotally connected between said second ends of said support and base plates;

connecting means between said first pair of hinged arms and between said second pair of hinged arms;

a stabilizer means having a stabilizer track rigidly secured to said base plate and extending upwardly between said first and second pairs of spaced apart hinged arms, said stabilizer track having a vertical slot through which moves a pin member to which first and second stabilizer arms are pivotally attached and extend outwardly therefrom in generally opposite directions to pivotal attachment to said first and second pairs of spaced apart hinged arms respectively; and an extensible and retractable power means attached between said connecting means of said first and second pairs of hinged arms to move said connecting means towards or away from each other which causes said first and second pairs of hinged arms to straighten upwardly or fold downardly which raises or lowers said support plate with respect to said base plate.

2. The device of claim 1 wherein each said hinged arm comprises an upper arm portion having a support plate end pivotally attached to said support plate and a middle end pivotally attached to a middle pivot means, a bottom arm portion having a base plate end pivotally attached to said base plate and a middle end pivotally attached to said middle pivot means.

3. The device of claim 2 wherein said upper arm portion and said bottom arm portion of each said hinged arm operate to pivot outwardly of said first and second ends of said support and base plates.

4. The device of claim 2 wherein said middle pivot means comprises a secured pin member.

5. The device of claim 1 wherein said first and second pairs of hinged arms are pivotally attached to said first and second opposite sides of said support and base plates by pin members.

6. The device of claim 1 wherein said connecting means comprises a rod member.

7. The device of claim 6 wherein said rod member extends between the pivot points of each pair of hinged arms.

8. The device of claim 1 wherein said power means is attached to said connecting means by pivoting attachments.

9. The device of claim 1 wherein said power means comprises a horizontally disposed hydraulic cylinder.

10. The device of claim 1 wherein said top and bottom plates are rectangular in configuration.

11. The device of claim 1 wherein additional stabilizer means is attached to said support plate.

12. The device of claim 1 wherein a reinforcement bar is rigidly secured to any of said first and second pairs of hinged arms.

13. The device of claim 2 wherein reinforcement bars are secured between any said upper arm portions of said first and second pairs of hinged arms and between any bottom arm portions of said first and second hinged arms.

14. The device of claim 9 wherein said hydraulic cylinder further comprises a safety valve means operatively connected between said hydraulic cylinder and a source of hydraulic pressure so that once hydraulic pressure is applied and maintained to said hydraulic cylinder said safety valve means operates to maintain the desired hydraulic pressure within said hydraulic cylinder regardless of a hydraulic pressure decrease at said hydraulic pressure source.

* * * * *